United States Patent [19]

Letica

[11] 4,429,805

[45] Feb. 7, 1984

[54] CONTAINER CONSTRUCTION

[75] Inventor: Ilija Letica, Oxford, Mich.

[73] Assignee: Letica Corporation, Rochester, Mich.

[21] Appl. No.: 376,312

[22] Filed: May 10, 1982

Related U.S. Application Data

[63] Continuation-in-part of Ser. No. 235,245, Feb. 17, 1981, Pat. No. 4,349,119, which is a continuation-in-part of Ser. No. 169,330, Jul. 16, 1980, Pat. No. 4,293,080.

[51] Int. Cl.[3] ..... B65D 41/16; B65D 41/18

[52] U.S. Cl. ..... 220/306; 220/307

[58] Field of Search ..... 220/72, 74, 306, 307, 220/355; 150/0.5

[56] References Cited

U.S. PATENT DOCUMENTS

| | | | |
|---|---|---|---|
| 3,942,679 | 3/1976 | Starr | 150/0.5 |
| 4,293,080 | 10/1981 | Letica | 220/306 |
| 4,349,119 | 9/1982 | Letica | 220/306 |
| 4,367,821 | 1/1983 | Holt | 220/72 |

*Primary Examiner*—George T. Hall

*Attorney, Agent, or Firm*—Krass, Young & Schivley

[57] ABSTRACT

A straight sided injection molded plastic container and lid combination wherein the cylindrical sidewall of the container exhibits a neck section of reduced interior diameter and structure in said neck section for reinforcement thereof in a direction parallel to the longitudinal axis of the container.

8 Claims, 8 Drawing Figures

CONTAINER CONSTRUCTION

CROSS REFERENCE TO RELATED APPLICATIONS

This application is a continuation-in-part of application Ser. No. 235,245 filed Feb. 17, 1981, now Patent No. 4,349,119, which is a continuation-in-part of application Ser. No. 169,330, filed July 16, 1980, now Patent No. 4,293,080.

TECHNICAL FIELD

The present invention generally relates to container assemblies, especially those molded from plastic material, and deals more particularly with a lid-to-container interlock for providing a fluid tight seal between the rim and container as well as a reinforced container rim.

BACKGROUND ART

The use of containers such as buckets and pails of unitary construction molded from plastic materials has become more widespread during recent years, due in part to the fact that they may be economically produced in large quantities. Molded plastic containers have replaced many types of previous metal constructions except in those applications where hazardous materials such as paints and thinners are intended to be packaged; these latter mentioned applications demand that the container be exceptionally rigid and not subject to rupture or leakage during shipping or ordinary use.

Previous molded plastic containers have not been completely successful in replacing metal constructions because prior art container-to-lid interlocks have not been entirely reliable in providing a seal which precludes leakage of the contents from the container. Although interlocks, such as that disclosed in U.S. Pat. No. 3,977,563, have previously been designed which form an essentially fluid tight seal under ordinary conditions of use, such seal may be easily broken and the lid inadvertently removed from the container if the rim is flexed.

Containers, such as those used to package paint and the like, are desirably formed with essentially smooth sidewalls, free of protuberances, so that the containers may be placed in side-by-side relationship to each other in a minimum amount of space. Reinforcement ribs, as shown in the disclosure of U.S. Pat. No. 3,977,563, extend radially outward beyond the sidewalls of the container and therefore increase the amount of space needed to package a number of such containers for shipping and storage purposes. Furthermore, such ribs interrupt the sidewall of the container so as to prevent the application of a label to the container adjacent the top thereof.

Another disadvantage of prior art containers of the type mentioned above resides in the fact that such containers possess relatively little axial strength adjacent the rim thereof, compared to metal constructions. Weakness in the rim in the axial direction results in the rim flexing or bowing, or otherwise deforming when a lid is either pried from, or applied to, the container under pressure.

Accordingly, it is an important object of the present invention to provide a molded plastic container assembly having an improved rim-to-lid interlock which provides a positive, reliable fluid tight seal even when subjected to rough handling, as during shipping thereof.

A further important object of the invention is to provide a container assembly of the type mentioned above which exhibits improved rigidity in the axial direction adjacent the rim, so as to preclude flexing of the rim during installation or removal of a lid from the container.

A still further object of the invention is to provide a container assembly as described above which is provided with longitudinal and circumferential reinforcement ribs adjacent the rim of the container which are inset into the container sidewalls, such that such sidewalls exhibit an essentially smooth, uninterrupted profile suitable for receiving a label thereon.

These and further objects of the invention will be made clear or will become apparent during the course of the following description of a preferred embodiment of the invention.

SUMMARY OF THE INVENTION

A resealable, cylindrical plastic container assembly molded from high density thermoplastic is provided with a novel rim and lid interlock construction which provides an extremely reliable rim-to-lid seal which may be broken only with the use of a specially configured tool. The container includes a plurality of circumferential and longitudinal reinforcement ribs adjacent the rim thereof which are inset into the container sidewalls so as to provide the sidewalls with a continuous, uninterrupted profile. A connecting flange above the reinforcement ribs supports a rim and provides a firm surface for supporting a pry tool used to remove the lid from the container. The rim comprises an exterior sealing bead and an interior locking lip connected by a substantially flat, inclined sealing surface. The lid includes interior and exterior locking portions defining a channel which grips and conformingly contacts the rim to provide a fluid tight seal between the bead and locking lip. Circumferentially spaced notches in the connecting flange are aligned with the vertical reinforcement ribs and provide access to a pry opening between the connecting flange and the lid.

BRIEF DESCRIPTION OF THE DRAWINGS

In the drawings, which form an integral part of the specification and are to be read in conjunction therewith, and in which like components are designated by identical reference numerals in the various views.

DETAILED DESCRIPTION OF THE INVENTION

Figure 1:
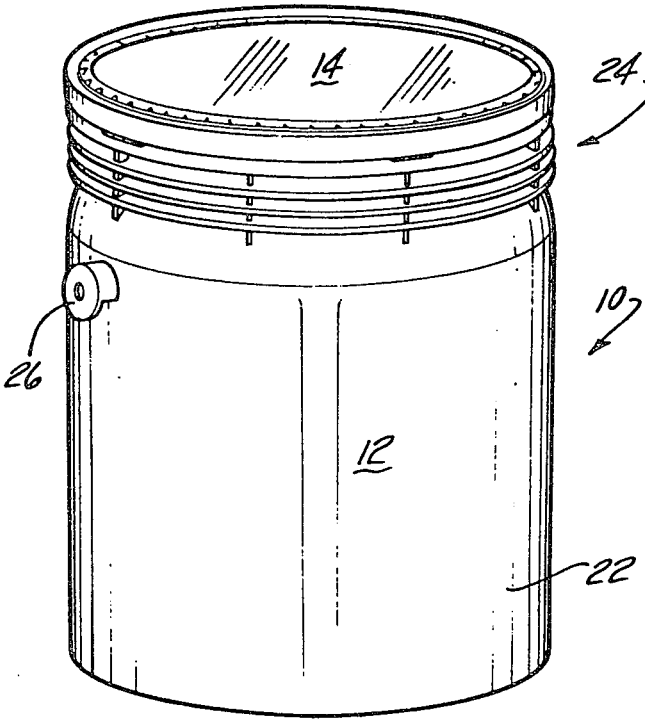
FIG. 1 is a top perspective view of the container construction which forms the preferred embodiment of the present invention, with the lid installed in interlocking, sealed relationship on the container rim.
Figure 2:
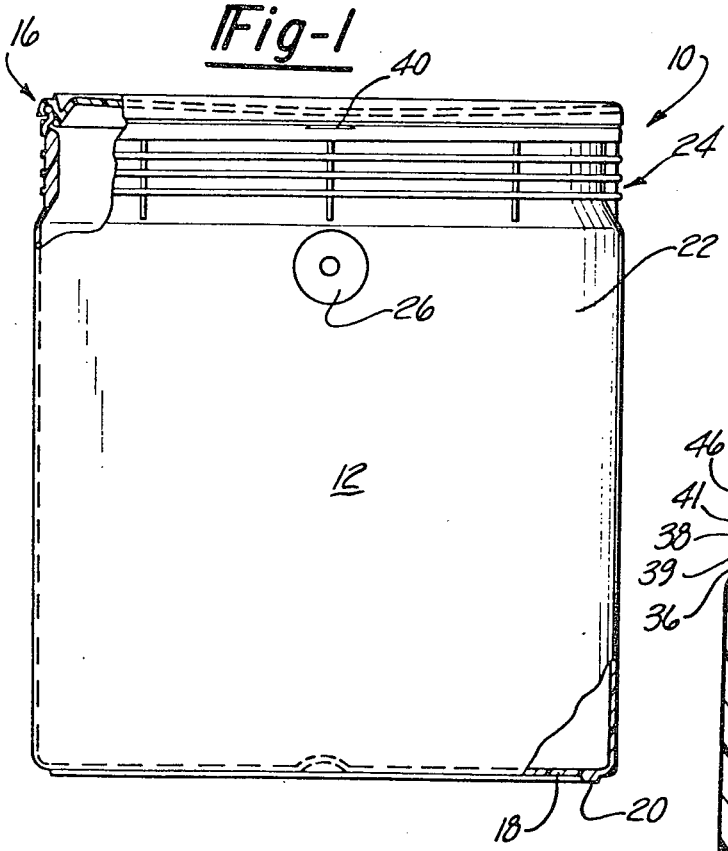
FIG. 2 is a side view of the container construction shown in FIG. 1, with parts being broken away in section for purposes of clarity.
Figure 3:
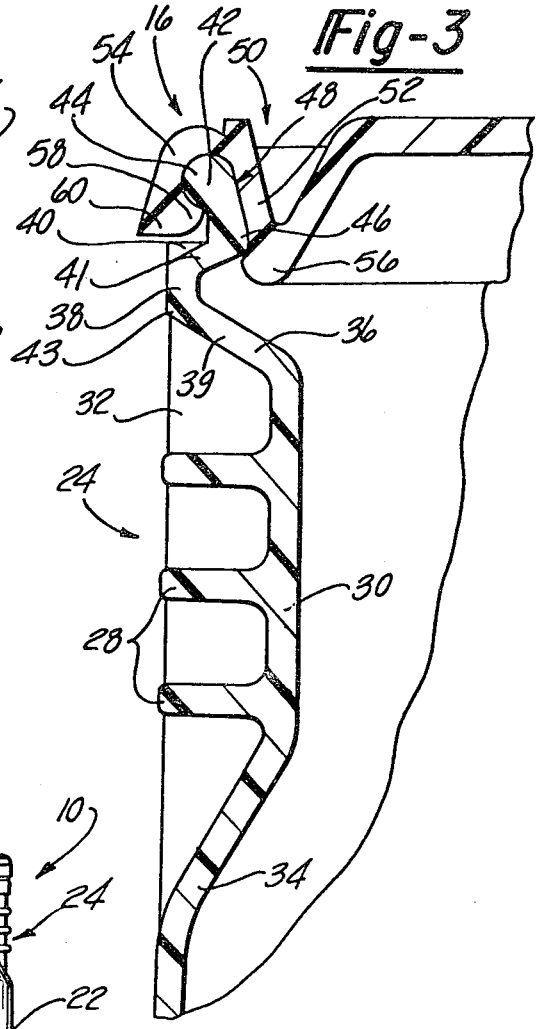
FIG. 3 is a fragmentary cross sectional view of the interlock between the container rim and lid of the container construction shown in FIGS. 1 and 2.
Figure 4:
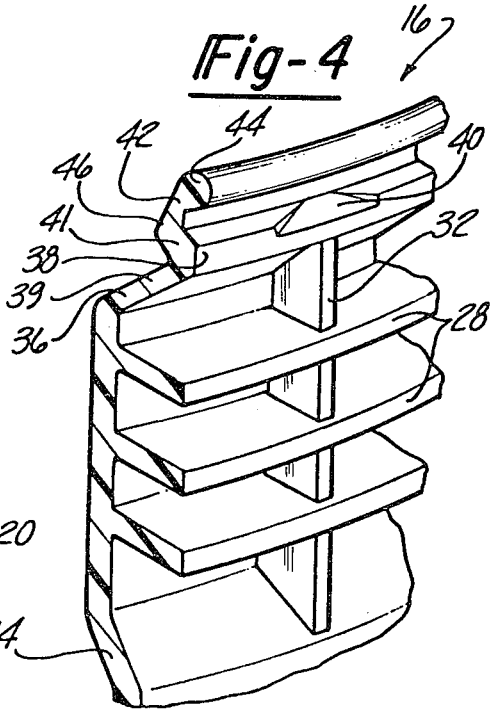
FIG. 4 is a fragmentary, sectional view taken in perspective of a portion of the container sidewall and rim, with the lid having been removed from the container.

Referring now to the drawings, a molded plastic container assembly, generally indicated by the number 10, comprises a cylindrically-shaped container 12 having a circular lid 14 connected to the top thereof by interlock means 16.

The container 12 is preferably injection molded from thermoplastic material, such as polyethylene, and possesses a density of 0.947 to 0.965 grams per cubic centimeter. The melt index of the thermoplastic material is preferably between 3 and 18 melt. The container 12 is provided with a circular bottom wall 18 having a peripheral, downwardly depending stacking flange 20 formed integral therewith. A cylindrically-shaped sidewall 22 extends upwardly from bottom wall 18 and includes a reinforcement section, generally indicated at 24, adjacent the open top thereof. A pair of handle brackets 26 are formed integral with the sidewall 22, on opposite sides thereof, and are adapted for mounting a conventional handle (not shown) on the container 12.

The reinforcement section 24 is defined by an inset in the sidewall 22, such that the inside diameter of sidewall 22 opposite the reinforcement section 24 is less in magnitude than the inside diameter of the sidewall 22 below the reinforcement section 24. Reinforcement section 24 is defined by a plurality of longitudinally spaced, essentially parallel, circumferentially extending reinforcement ribs 28 which extend radially outward from a connecting wall 30 to a point substantially even with the profile defined by the exterior surface areas of sidewall 22. The reinforcement section 24 further includes a plurality of longitudinally extending, circumferentially spaced vertical reinforcement ribs 32 which extend transverse to ribs 28 and are connected to inset walls 34 and 36.

A connecting flange 38 extends upwardly from the reinforcement section 24. Connecting flange 38 is a U-shaped circumferential ridge including a first leg 39 which extends from inset wall 36 upwardly and radially outward. Said connecting flange further includes a second leg 41 which extends radially inward from the upper end 43 of said first leg 39. Said second leg 41 is provided with a plurality of access notches 40 therein which are circumferentially aligned in registration above vertical reinforcement ribs 32 and present downwardly inclined surface areas adjacent the outer edge of flange 38. A rim 42 extends upwardly from flange 38 and defines the circular open top of the container 12. Rim 42 comprises a semi-circular shaped bead 44 on the upper extremity thereof, extending radially outward and spaced above the flange 38. An arcuately-shaped locking lip 46 is defined on the opposite extremity of rim 42, interior of the container 12. Bead 44 and locking lip 46 are connected by a substantially flat, inclined sealing surface 48 extending therebetween inside the container 12.

The lid 14 is formed of flexible thermoplastic material and is provided with a V-shaped stacking groove 50 near the periphery thereof which is adapted to matingly receive the stacking flange 20 when the containers 10 are stacked upon each other. Lid 14 includes a locking channel defined by a pair of spaced legs 52 and 54 adapted to grip and conformingly engage the rim 42 therebetween. The channel includes an interior locking portion 56 defined by interior locking edges which conformingly grip locking lip 46, and an exterior locking portion 58 including exterior locking edges conformingly engaging essentially the entire periphery of the bead 44. Leg 54 is provided with a prying flange 60 which extends radially outward beyond the sidewall 22. Prying flange 60 is spaced slightly above the connecting flange 38 so as to define an access opening between the lid 14 and container 12 at the notch 40. Leg 52 of the lid channel presents an interior wall surface which contacts essentially an entire sealing surface 48, while leg 54 contacts essentially the entire surface area presented by bead 44. Thus, it is apparent that a seal of substantial area is formed between the rim 42 and interlocking peripheral channel defined in lid 14.

In use, the lid 14 may be installed on the container 12 by applying a vertical, downwardly directed force along the lid channel; by virtue of the flexibility of lid 14, legs 52 and 54 flex away from each other upon engagement with rim 42 until the interior and exterior locking portions 56 and 58 clear the locking lip 46 and bead 44. At this point, legs 52 and 54 spring inwardly and the interior and exterior locking portions 56 and 58 conformingly grip the locking lip 46 and bead 44 to form an exceptionally tight seal between the container 12 and lid 14. By virtue of the fact that the reinforcement section 24 is inset in the sidewalls 22 of the container 12, a plurality of the container assemblies 10 may be disposed in side-by-side relationship in a minimum amount of space since the sides of each container assembly 10 are essentially free from protuberances.

In order to remove the lid 14 from the container 12, a prying tool (not shown) such as a screw driver is inserted between the prying flange 60 and connecting flange 38 at one of the notches 40. The inclined surface areas of the notch 40 allows penetration of the prying tool such that the exterior locking portion 58 of the lid 14 may be engaged and pried away from the bead 44. Continued upward prying force applied to the periphery of the lid 14 breaks the seal, especially along the sealing surface 48 until a section of the interior locking portion 56 is urged into clearing relationship to the locking lip 46, at this point, the prying tool may be inserted into another adjacent notch 40, and the prying process repeated until the seal is broken substantially around the entire periphery of the lid 14.

As the lid 14 is removed and reinstalled on the container 12, the vertical reinforcement ribs 32 provide the container rim with added rigidity in an axial direction so as to prevent flexion or deformation thereof. The circumferential reinforcement ribs 28 provide the container rim with added hoop strength, which likewise reduces flexion or distortion. The cooperation of the first leg 39 and second leg 41 of the connecting flange 38 prevents the rim 42 from flexing due to the force of a prying tool bearing on said connecting flange.

Figure 5:
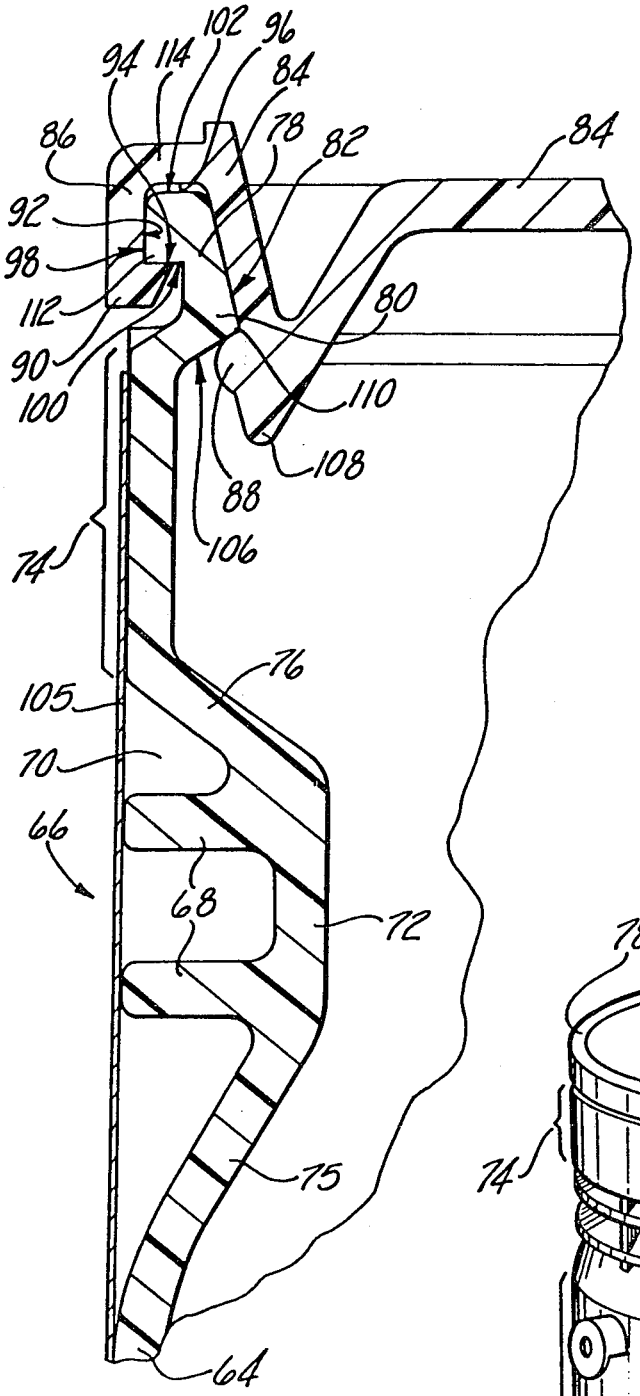
FIG. 5 is a fragmentary, cross sectional view of the interlock between the rim and lid of an alternate form of the container.
Figure 6:
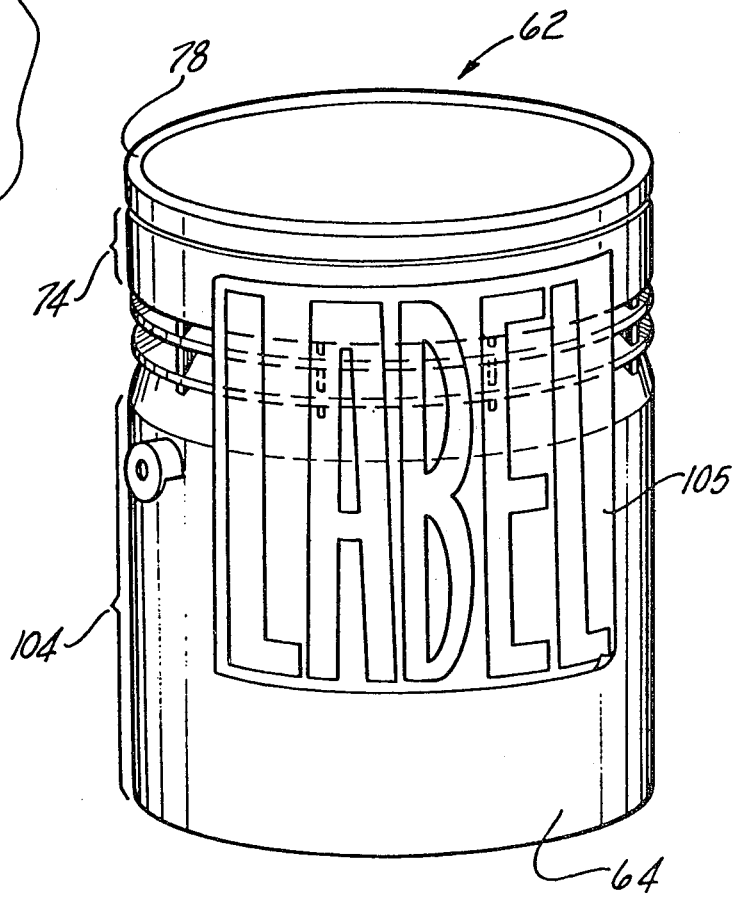
FIG. 6 is a perspective view of the container shown in FIG. 5, with the lid removed.

Attention is now directed to FIGS. 5 and 6, wherein an alternate form of the container construction is depicted. The alternate container construction 62 includes a body having a cylindrically-shaped sidewall 64 defined by axially spaced, upper and lower sidewall portions 74 and 104, respectively. Sidewall portions 74 and 104 are connected by a reinforcement section, generally indicated by the numeral 66.

Reinforcement section 66 is similar to that previously described with reference to FIGS. 1–4, and includes a pair of axially spaced, circumferential reinforcement ribs 68 extending outwardly from connecting wall 72 which is in turn connected to the upper and lower sidewall portions 74 and 104 by corresponding legs 75 and 76. A plurality of circumferentially spaced, axial reinforcement ribs 70 extend between legs 75 and 76 and intersect circumferential ribs 68.

The exterior surface of the upper sidewall portion 74 possesses sufficient axial length so as to present a substantial exterior surface area to which the upper portion of a label 105 may be applied, as with adhesive. The label 105 extends downwardly into conforming engagement with the lower sidewall portion 104 as well as the outer extremities of the circumferential ribs 68. It may thus be appreciated that although the reinforcement section 66 presents a substantial discontinuity in the surface of the sidewall 64, the increased length of the upper sidewall portion 74 allows the label 105 to be applied to the container adjacent the top thereof.

A rim 78 is formed integral with the upper extremity of sidewall portion 74 and includes first and second, generally planar surface areas 98 and 100 which intersect at a substantially right angle to define a relatively sharp exterior corner 112. A third essentially planar surface 102 on top of the rim 78 extends essentially parallel to the second surface 100 and is contiguous with an inclined sealing surface 82 inside the container rim 78. Surface 82 intersects with another inclined interior surface 106 to define a relatively sharp interior corner 110.

The container 62 further includes a lid 84 having a locking edge around the periphery thereof for locking with the rim 78 to provide a fluid tight seal. The locking edge comprises an outer leg 86 and an inner leg 84 connected by a connecting leg 114. The outer leg 86 includes a pry flange 90 on the lower extremity thereof, which extends into a notch in the rim 78, similar to the container construction depicted in FIGS. 1–4. Outer leg 86 and pry flange 90 respectively include first and second essentially planar faces 92 and 94 which intersect to define a sharp angular groove within which there is received the exterior corner 112. Face 92 conformingly engages surface 98, while face 94 conformingly engages surface 100.

The connecting leg 114 includes an essentially planar face 96 which opposes surface 102 and is spaced from the latter. Leg 84 is provided with a planar interior face which conformingly engages the interior sealing surface 82 and intersects surface areas defining an arcuately shaped, interior locking portion 88 so as to provide another sharp angular groove for matingly receiving the interior corner 110 therein. A guide flange 108 which is radially spaced inwardly somewhat from the locking portion 88 depends downwardly from the latter and functions to slidably engage the sealing surface 82 when the lid 84 is installed on the container so as to maintain the lid 84 in aligned registration with the rim 78.

It has been found that the sharp angular interior and exterior corners 110 and 112, and the corresponding angular grooves of the lid 84 provide a substantially improved fluid tight seal between the lid 84 and the rim 78 which eliminates the need for a sealing gasket, in many applications. If desired, however, a gasket (not shown) may be interposed in the gap between face 96 and surface 102 so as to completely eliminate the possibility of fluid leakage. Alternatively, a suitable sealing paste may be applied to the sealing surfaces of the lid 84 and rim 78 to assure a fluid tight seal.

Figure 7:
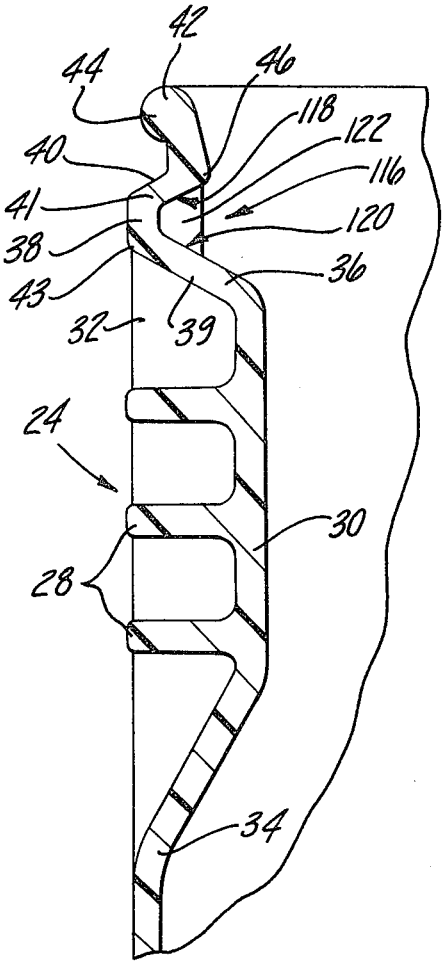
FIG. 7 is a fragmentary cross sectional view of an alternate form of the container rim; and, FIG. 8 is a fragmentary sectional view, taken in perspective of the inside of the rim of the container shown in FIG. 7.
Figure 8:
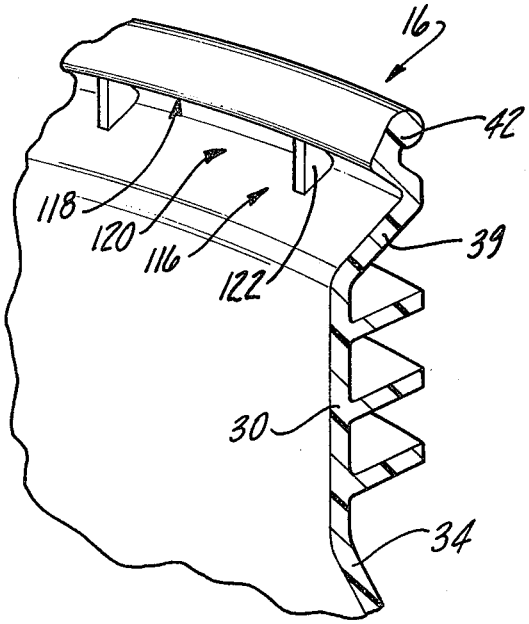

Reference is now made to FIGS. 7 and 8 wherein another alternate form of the container 12 is depicted. The reinforcement section 24 is similar to that previously described which is defined by the inset section 24 in the sidewall 22. Reinforcement section 24 is further defined by a generally U-shaped, circumferentially extending depression 116 in the interior face of sidewall 22, immediately below connecting flange 38 and rim 42. Depression 116 is defined by opposing surface areas 118 and 120. A plurality of circumferentially spaced, longitudinally extending reinforcement ribs 122 are disposed within depression 116 and connect surface areas 118 and 120. Ribs 122 function to further strengthen the rim 42.

From the foregoing, it is apparent that the container assembly and novel interlock described above not only provide for the reliable accomplishment of the objects of the invention, but do so in a particularly economical and effective manner. It is recognized, of course, that those skilled in the art may make various modifications or additions to the preferred embodiment chosen to illustrate the invention without departing from the scope and spirit of the present contribution to the art. Accordingly, it is to be understood that the protection sought and to be afforded hereby should be deemed to extend to the subject matter claimed and all equivalents thereof fairly within the scope of the invention.

I claim:

1. A plastic container, comprising:

a base;

a generally cylindrical sidewall extending upwardly from said base and defining an open top of said container opposite of said base, said sidewall including a section therein radially inset from said sidewall and adjacent said open top; and means within said inset section for stiffening said inset section in a direction essentially parallel to the longitudinal axis of said container.

2. The container of claim 1, wherein said inset section includes at least a first portion defined by a circumferential depression in the interior surface of said sidewall and said stiffening means includes at least a first plurality of circumferentially spaced, longitudinally extending ribs formed integral with said sidewall and substantially within said depression.

3. The container of claim 2, wherein said inset section includes a second portion defined by a circumferential depression in the exterior surface of said sidewall and said stiffening means includes a second plurality of circumferentially spaced, longitudinally extending ribs formed integral with said sidewall and substantially within said last mentioned depression.

4. An injection molded, thermoplastic container adapted to have a lid removably installed thereon, comprising:

a base;

a generally cylindrical sidewall formed integral with and extending upwardly from said base, the top of said container opposite said base being open, said sidewall including a circumferentially extending depression in the interior surface thereof adjacent said top and defined by a pair of opposing surfaces of said sidewall; and means substantially within said depression for longitudinally reinforcing said sidewall at said depression.

5. The container of claim 4, wherein said depression is essentially U-shaped in cross section and said reinforcing means includes a plurality of ribs extending longitudinally between said opposing surfaces and formed integral with the latter.

6. The container of claim 4, including a lip on said sidewall around said top and immediately above said depression, said lip being adapted for conjugally receiving said lid thereon.

7. The container of claim 4, wherein said container includes a circumferentially extending depression in the exterior surface thereof and longitudinal reinforcement ribs with said last mentioned depression.

8. A molded plastic container, comprising:

a base;

a generally cylindrical sidewall extending upwardly from said base and including a rim defining an open top on said container, said sidewall including a neck adjacent said top, said neck defining an area of reduced interior diameter in said sidewall;

a lid removably secured on said rim; and means at said neck and extending longitudinally relative to the central axis of the container for reinforcing said neck in a direction parallel to said central axis, said reinforcing means being disposed below said rim.

* * * * *